US009124972B2

(12) United States Patent
Graumann

(10) Patent No.: US 9,124,972 A0
(45) Date of Patent: Sep. 1, 2015

(54) VOICE-BEARING LIGHT

(75) Inventor: David L. Graumann, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 1597 days.

(21) Appl. No.: 10/024,814

(22) Filed: Dec. 18, 2001

(65) Prior Publication Data

US 2003/0112984 A1 Jun. 19, 2003

(51) Int. Cl.

| | |
|---|---|
| ***H04R 3/00*** | (2006.01) |
| ***H04R 1/02*** | (2006.01) |
| ***H04R 1/08*** | (2006.01) |

(52) U.S. Cl.

CPC ..... *H04R 1/083* (2013.01)

(58) Field of Classification Search

USPC ..... 381/111–115, 110, 172, 91, 122, 92; 362/253, 86, 87–88

See application file for complete search history.

(56) References Cited

U.S. PATENT DOCUMENTS

| | | | | |
|---|---|---|---|---|
| 4,566,135 | A * | 1/1986 | Schmidt | 398/132 |
| 4,567,608 | A * | 1/1986 | Watson et al. | 381/122 |
| 5,805,717 | A * | 9/1998 | Mills | 381/110 |
| 5,903,871 | A * | 5/1999 | Terui et al. | 704/500 |
| 6,154,551 | A * | 11/2000 | Frenkel | 381/172 |
| 6,473,514 | B1 * | 10/2002 | Bodley et al. | 381/355 |
| 6,526,147 | B1 * | 2/2003 | Rung | 381/92 |

FOREIGN PATENT DOCUMENTS

| | | | |
|---|---|---|---|
| DE | 2554229 | * | 6/1977 |
| EP | 1 008 277 | B1 | 8/2001 |
| GB | 2 071 962 | A | 9/1981 |
| WO | WO85/01411 | | 3/1985 |

OTHER PUBLICATIONS

German Office Action mailed Foreign Associate Mar. 22, 2005.

N/A, "Andrea's Technologies Overview", Http://www.andreaelectronics.com/technology.htm, 1-9, (Nov. 16, 2001).

N/A, "GN Netcom Introduces the Voice Array Voice—Isolating Microphone for Quality-Critical Voice-Driven PC Applications", Http://www.prnewswire.com/cgi-bin/micro_stories.p1.../0001108899&EDATE=Jan+6,+200, 1-8, (Nov. 16, 2001).

N/A, "Telex Announces Availability of Industry's First USB Desktop Microphone for Speech Recognition", Http://www.computeraudio.telex.com/news/111199.html, 1-4, (Nov. 11, 1999).

* cited by examiner

*Primary Examiner* — Xu Mei

(74) *Attorney, Agent, or Firm* — Joni D. Stutman

(57) ABSTRACT

The present invention guides a talker into a narrow sensitivity region by providing a light that is only visible when the talker's eyes are just above the sensitivity region of a microphone. When the talker keeps the light within his sight while speaking, there is no wavering problem. If the talker cannot see the light, then he is outside the sensitivity region and is alerted to a potential wavering problem by not seeing the light. In this way, the present invention takes advantage of the fact that the talker's eyes are located in close proximity to his mouth. In addition, high frequencies emanating from the mouth are highly directional and applications with speech input, such as speech recognition, function better when these high frequencies are available for analysis.

18 Claims, 12 Drawing Sheets

VOICE-BEARING LIGHT

BACKGROUND

Some speech capturing systems require a close-talking microphone located a few inches to the side of a talker's mouth, when the talker is in a noisy environment. However, these microphones are too cumbersome for many applications requiring speech input. There is a need for a speech capturing system that does not require a close-talking microphone.

Other microphones, such as microphone arrays, include signal-processing methods that reduce reverberation and noise. These signal-processing methods need a narrow sensitivity region. FIG. 1 is a block diagram of an example microphone array oriented in three-dimensional space. A sensitivity region (a/k/a pick-up pattern or sensitivity pattern) is an area near the system where speech is picked-up; thus, speech outside the sensitivity region is not adequately captured. FIG. 2 is a graph in polar coordinates showing the sensitivity region of the example microphone array of FIG. 1 of a 1-kHz tone presented to the microphone array at various locations along the x-axis. FIG. 3 is another graph in polar coordinates showing the sensitivity region of the example microphone of FIG. 1 of a 1-kHz tone presented to the microphone array at various locations along the y-axis.

The narrow sensitivity regions required by the signal processing methods are invisible to the eye and often narrower than a talker's normal head movement. One example is a microphone array along the top of a computer monitor with a ±30 degree azimuth sensitivity region. Another example is a microphone in an automobile with a ±15 degree azimuth sensitivity region. Given these narrow sensitivity regions, it is too easy for the talker to unknowingly move their mouth in and out of this region, resulting in captured speech that wavers between audible and inaudible. Yet, if this region is broadened to account for normal head movement, the system's ability to reject noise and reverberation is diminished. There is a need for a speech capturing system that avoids the wavering problem, without broadening the sensitivity region.

Some speech capturing systems attempt to electronically steer a narrow beam to the source of speech based on direction of arrival and tracking schemes. These methods do not work well because they cannot track fast enough and cannot predict movement when the talker pauses without large signal delays. Steering always lags the speech and cannot predict where speech will resume after a silent period. Furthermore, steering done with directional beam formations causes high frequency fluctuations in captured speech. There is a need for a new approach, one that brings the talker to the narrow sensitivity region, rather than reaching out to the talker. There is a need for a way to guide the talker to the narrow sensitivity region and to assure the talker remains in the region, without resorting to steering.

DETAILED DESCRIPTION

Systems and apparatus, such as speech capturing systems and voice-bearing lights are described. The following detailed description refers to the drawings in this application. The drawings illustrate specific embodiments to practice the present invention and, in these drawings, the same reference numbers are used for substantially similar components. This application describes embodiments of the present invention in sufficient detail to enable those skilled in the art to practice the present invention. In addition, other embodiments that vary in structural, logical, mechanical, and electrical ways do not depart from the scope of the present invention.

The present invention guides the talker into a narrow sensitivity region by providing a light that is only visible when the talker's eyes are just above the sensitivity region of a microphone. When the talker keeps the light within his sight while speaking, there is no wavering problem. If the talker cannot see the light, then he is outside the sensitivity region and is alerted to a potential wavering problem by not seeing the light. In this way, the present invention takes advantage of the fact that the talker's eyes are located in close proximity to his mouth. In addition, high frequencies emanating from the mouth are highly directional and applications with speech input, such as speech recognition, function better when these high frequencies are available for analysis. If the talker is directed to stay within the sensitivity region by visual feedback, then it is likely his mouth is pointing in the same direction as his eyes. In this way, the present invention reduces high frequency fluctuations that occur with directional beam formations. Also, it avoids the wavering problem, without broadening the sensitivity region.

This approach brings the talker to the narrow sensitivity region, rather than reaching out to the talker. It guides the talker to the narrow sensitivity region and assures that the talker remains in the region, without resorting to steering or requiring a close-talking microphone. Noise reduction and other signal processing can be applied more aggressively when the talker is known to be within the sensitivity region.

Figure 1:
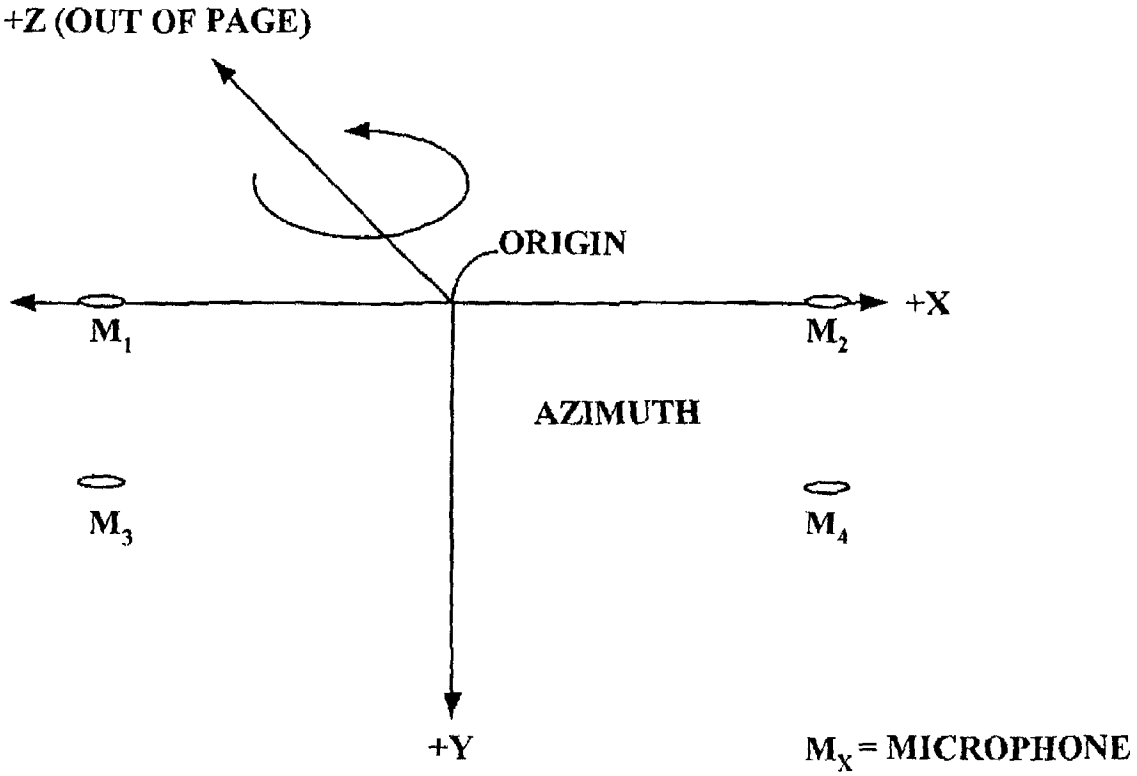
FIG. 1 (PRIOR ART)
FIG. 1 is a block diagram of an example microphone array oriented in three-dimensional space.
Figure 2:
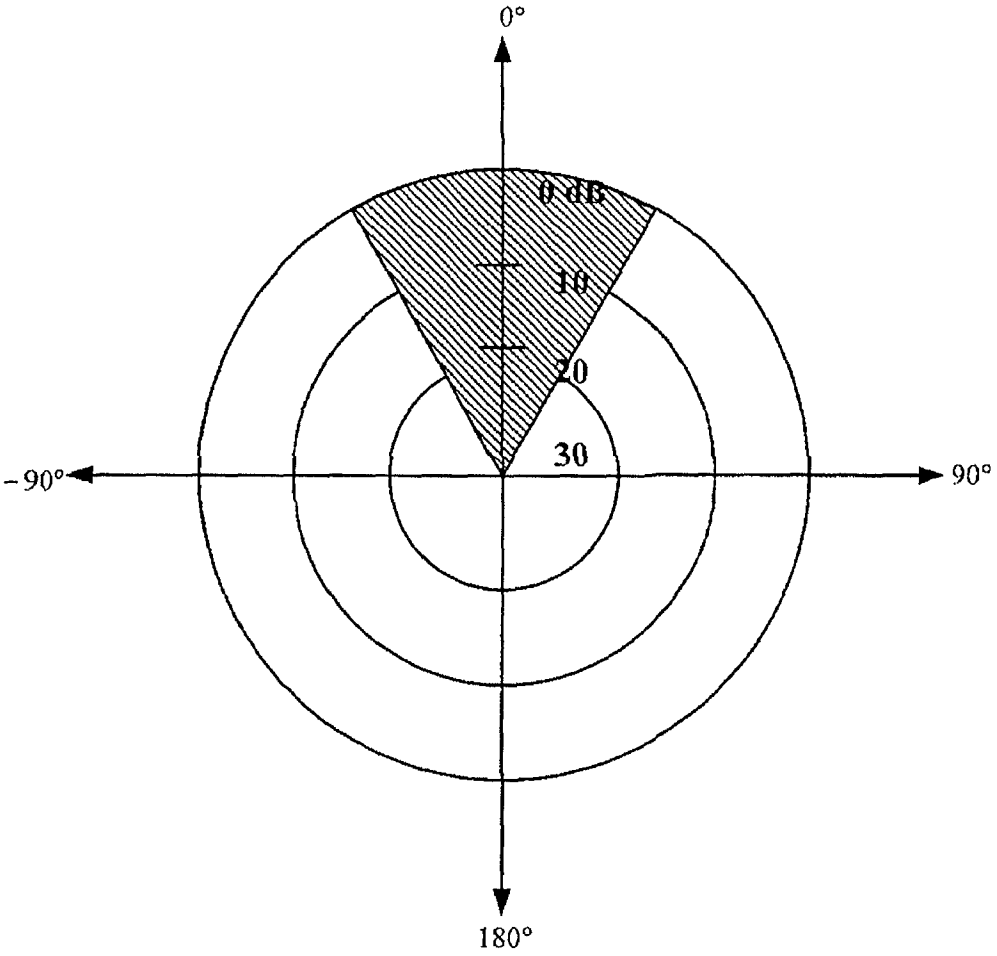
FIG. 2 (PRIOR ART)
FIG. 2 is a graph in polar coordinates showing the sensitivity region of the example microphone array of FIG. 1.
Figure 3:
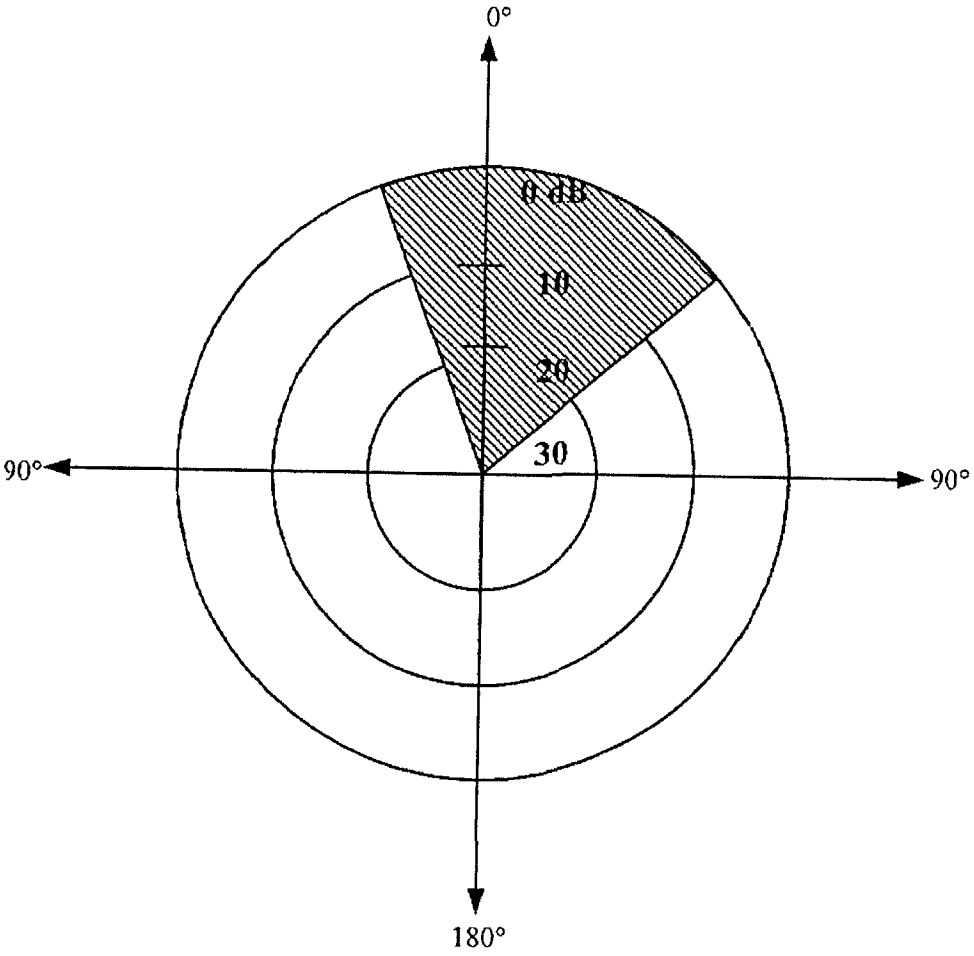
FIG. 3 (PRIOR ART)
FIG. 3 is another graph in polar coordinates showing the sensitivity region of the example microphone array of FIG. 1.
Figure 4:
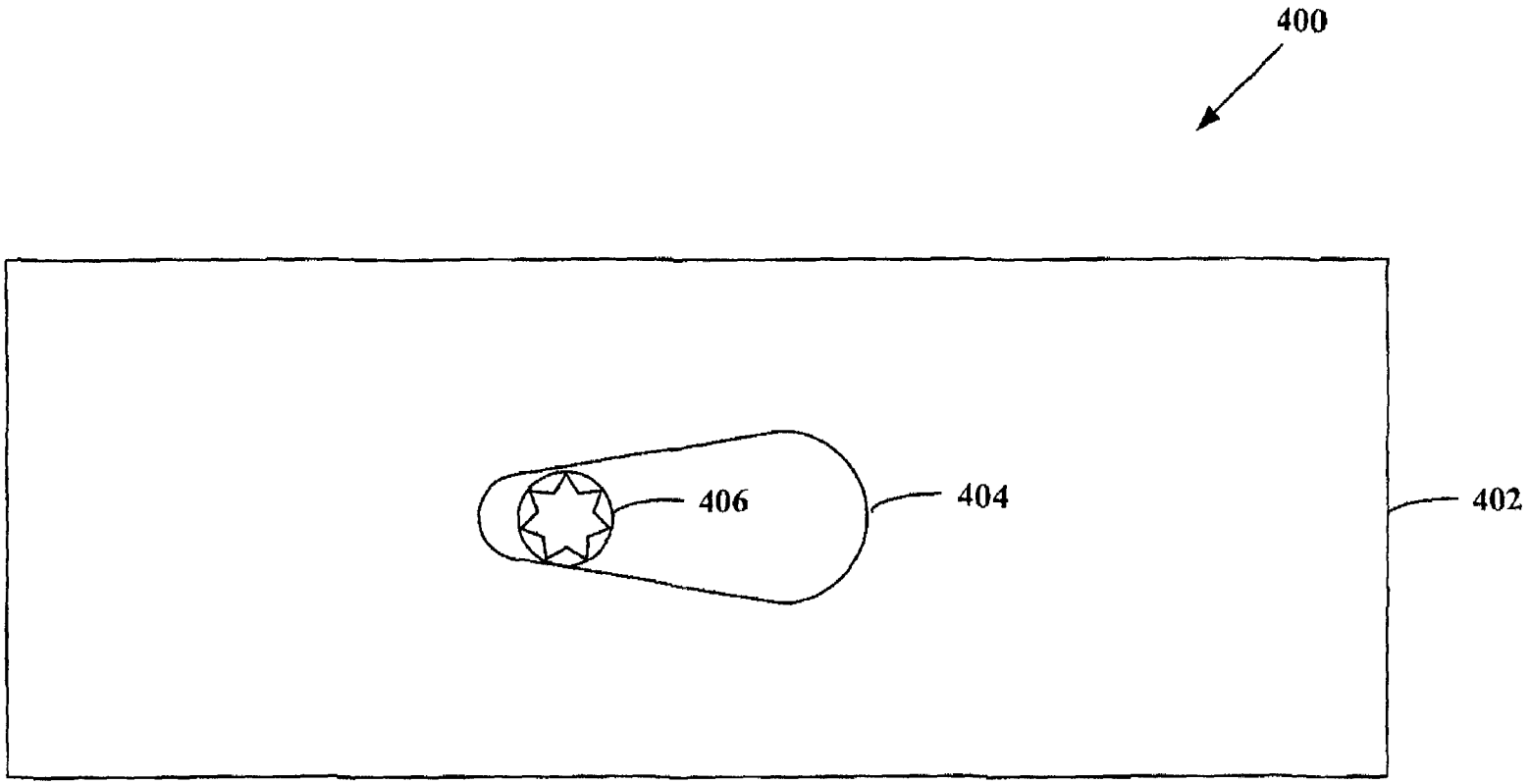
FIG. 4 is a top view of an embodiment of the present invention as a voice bearing light.
Figure 5:
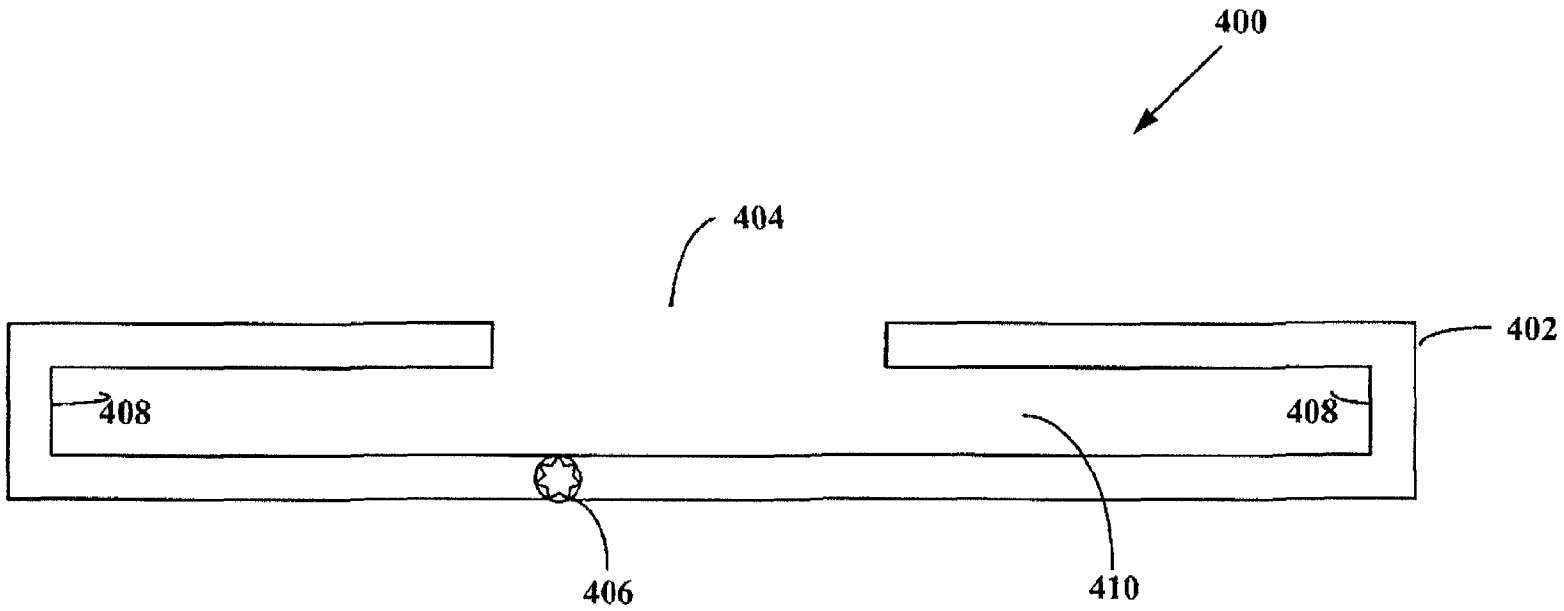
FIG. 5 is a side view of the voice bearing light of FIG. 4.
Figure 6:
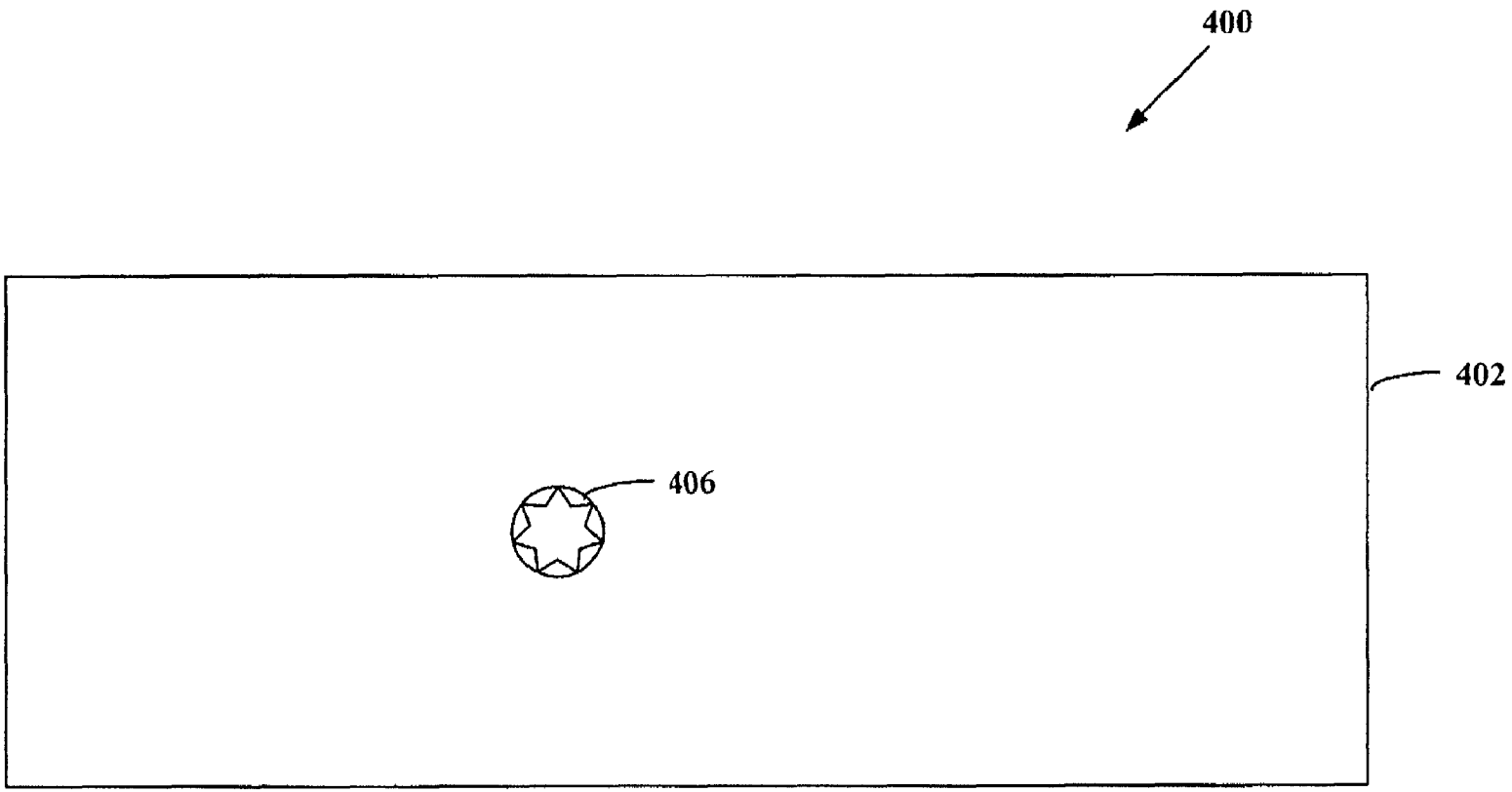
FIG. 6 is a bottom view of the voice bearing light of FIG. 4.
Figure 7:
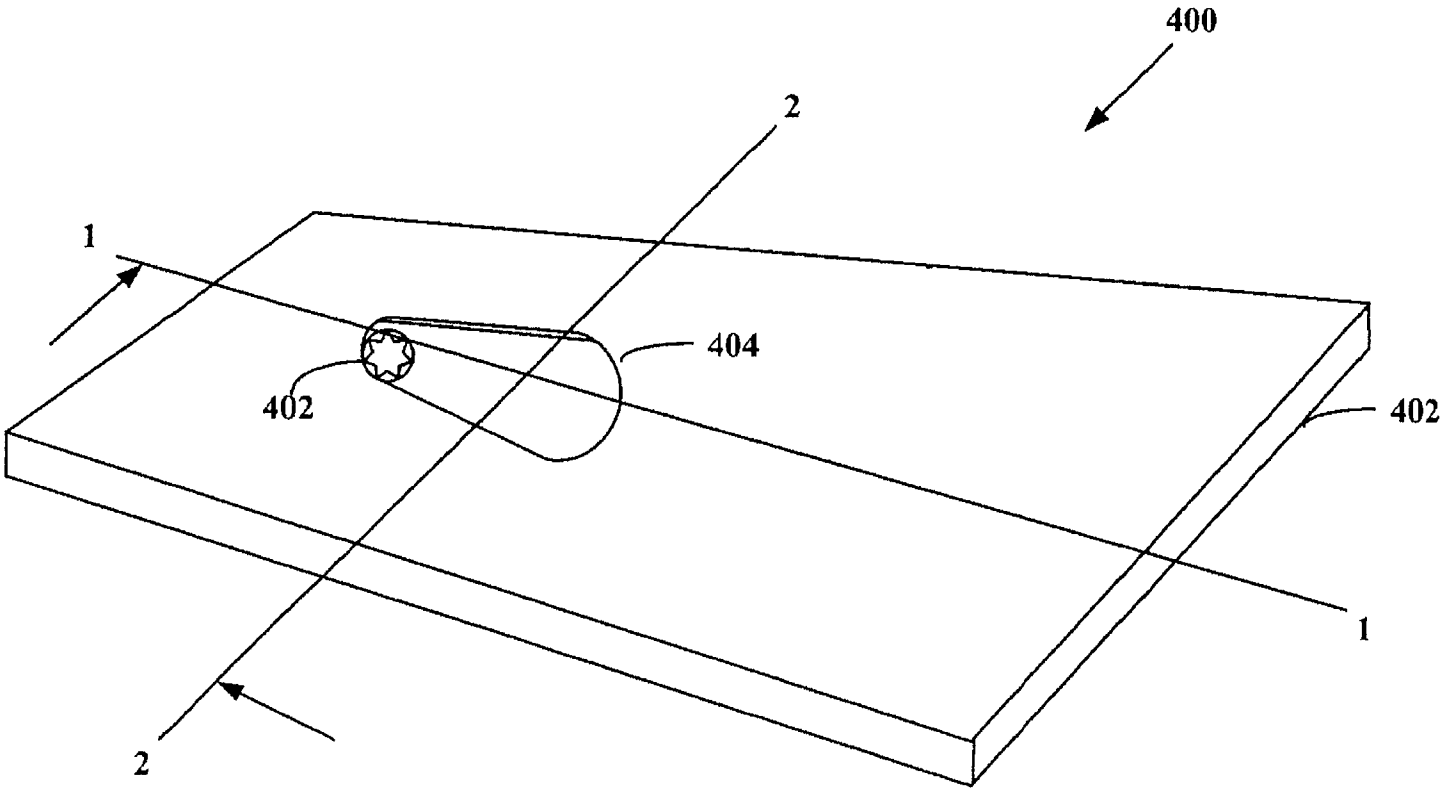
FIG. 7 is a perspective view of the voice bearing light of FIG. 4.

FIGS. 4–7 show an embodiment of the present invention as a voice-bearing light 400. FIG. 4 is a top view, FIG. 5 is a side view, FIG. 6 is a bottom view, and FIG. 7 is a perspective view. One aspect of the present invention is an apparatus, such as a voice-bearing light 400. The apparatus comprises an enclosure 402 having an opening 404 and a light-emitting device 406 inside the enclosure 402. The light emitted through the opening 404 is only visible to a speaker when the speaker's mouth is within a sensitivity region of a microphone. The light-emitting device 406 can be placed anywhere inside the enclosure to accommodate the sensitivity region. Any type of microphone will work, including a microphone array in 1 or 2 dimensions using Time Delay Estimation to establish a narrow sensitivity region.

In one embodiment, the enclosure 402 has sloped sides. In another embodiment, the walls 408 of the enclosure 402 (see FIG. 5) are coated to absorb light. In another embodiment, the opening 404 is asymmetrical. In another embodiment, the enclosure 402 is cylindrical. In another embodiment, the light-emitting device 406 is located on the bottom inside the enclosure 402.

In another embodiment, the opening 404 is located on the top of the enclosure 402.

Another aspect of the present invention is an apparatus, such as a voice-bearing light 400 that comprises an enclosure 402 having an opening 404 to a cavity 410 (see FIG. 5) and a light-emitting device 406 at the bottom of the cavity 410. For example, the cavity can be narrow like a tube. The light emitted from the opening 404 is only visible to a speaker when the speaker's mouth is within a sensitivity region of a microphone. The surfaces of the cavity may be rounded and the opening may be positioned to meet design needs.

In one embodiment, the apparatus 400 further comprises a cover 412 (see FIGS. 8 and 9) over the light-emitting device 406 to diffuse the light. One example of a cover is a translucent lens. In another embodiment, the sides of the cavity 410 are sloped. In another embodiment, the enclosure 402 is capable of attaching to the microphone. One example of attachment is positioning the enclosure appropriately on top of the directionality of the microphone capture device. Attachment may be accomplished by any means, such as gluing, welding, etc.

Figure 8:
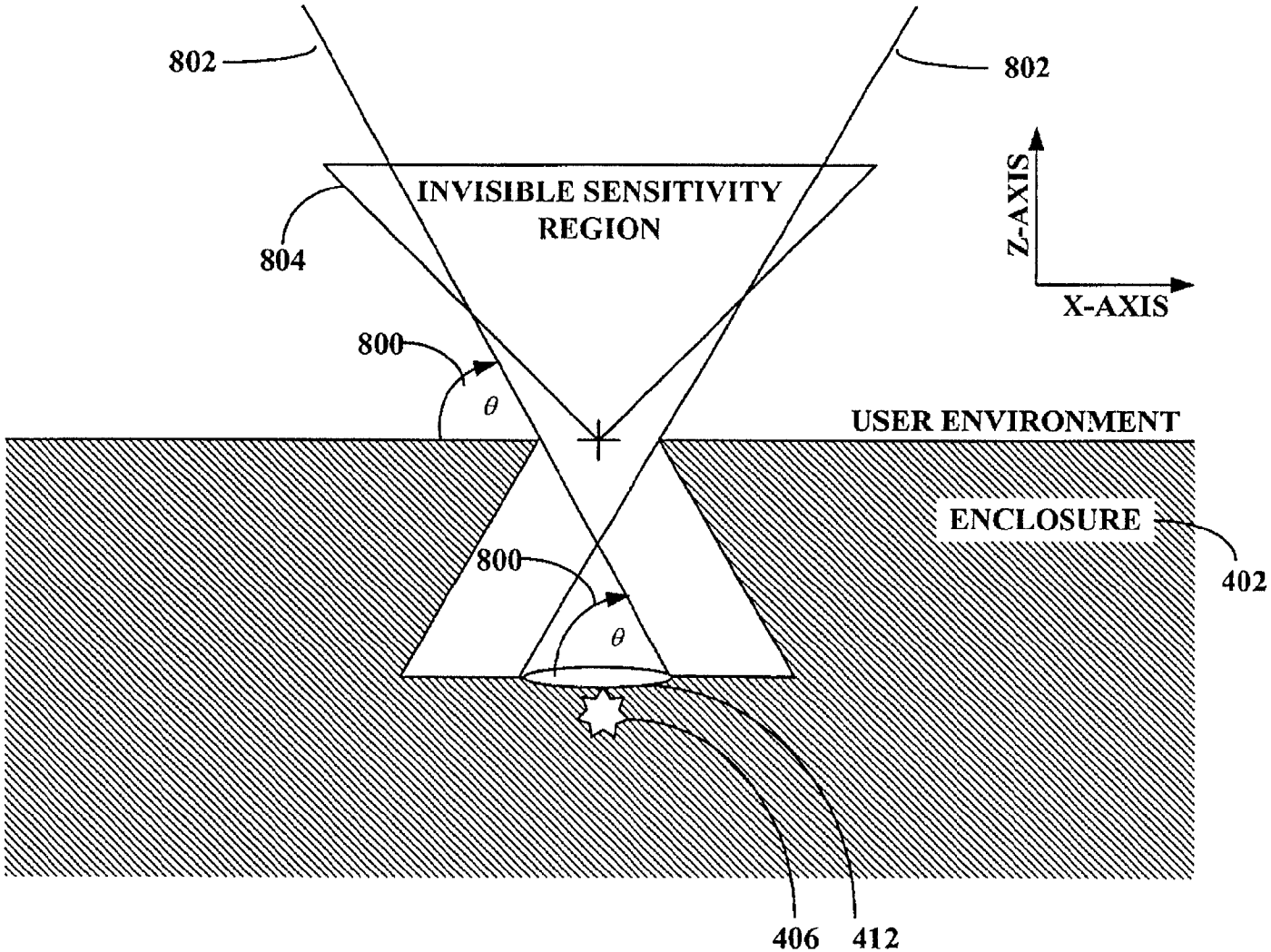
FIG. 8 is a sectional view of the voice bearing light of FIG. 7 taken from the line labeled 2.
Figure 9:
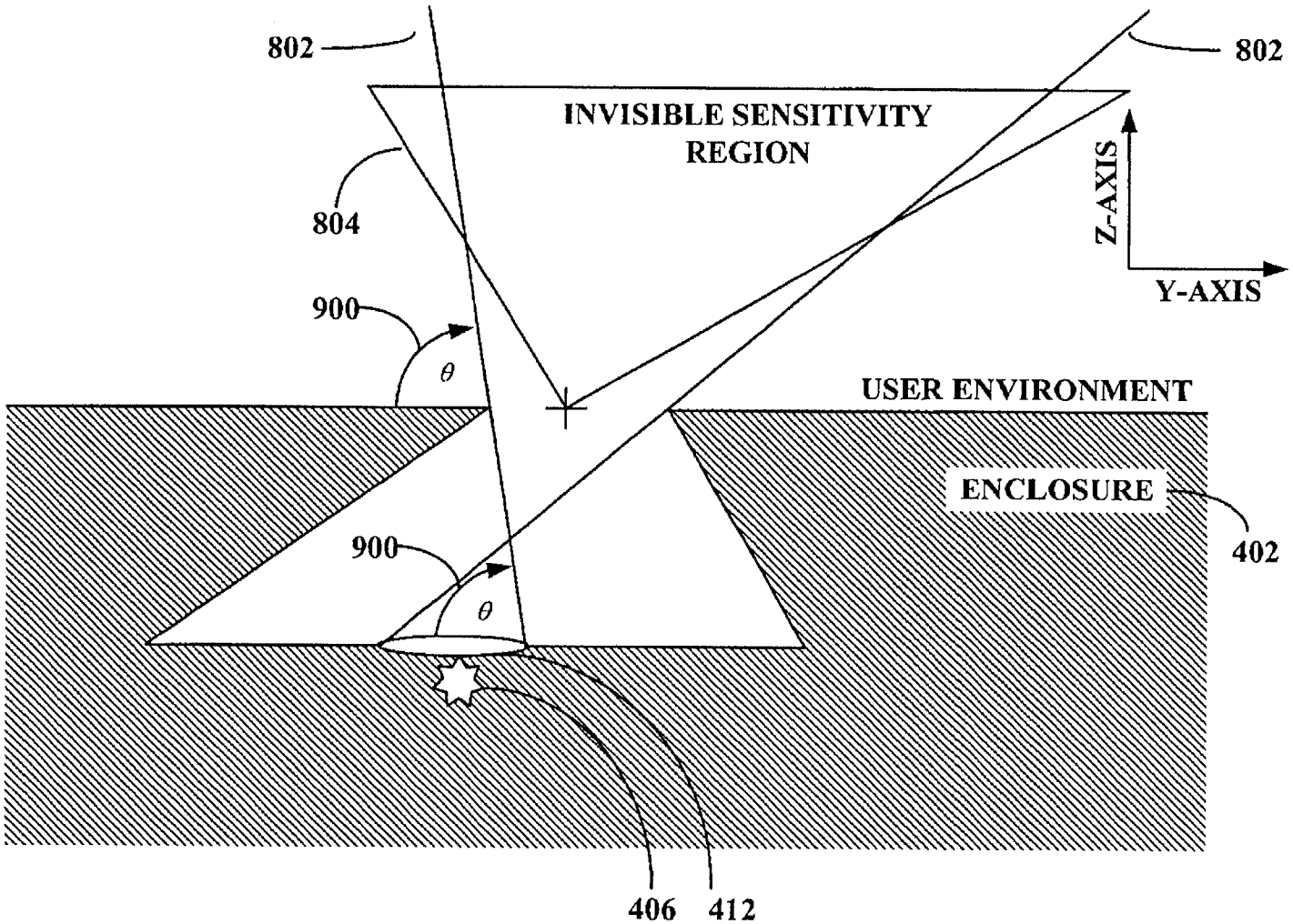
FIG. 9 is a sectional view of the voice bearing light of FIG. 7 taken from the line labeled 1.

FIGS. 8 and 9 are sectional views. FIG. 8 is a sectional view of the voice bearing light 400 of FIG. 7 taken from the line labeled 2. FIG. 8 is the cross-section of the z-x plane at y=0 with the Cartesian Coordinates origin at the center cross. FIG. 8 shows the example geometry of a cone-like structure. A talker at angles greater than theta (θ) 800 is able to see the illumination of the light-emitting device 406. Theta (θ) 800 is the angle between the surface of the cover 412 (or the light-emitting device 406, if there is no cover) and a projection line 802 drawn from one edge of the opening to the opposite edge of the cover 412. The projection lines 802 drawn from each edge to each corner of the cover 412 approximate the invisible microphone sensitivity region 804. In this way, the light is visible when the talker's mouth is within the sensitivity region and not visible when the talker is outside the region. The walls inside the enclosure may be coated with a light absorbing color and/or sloped to coincide with or exceed theta (θ).

FIG. 9 is a sectional view of the voice bearing light 400 of FIG. 7 taken from the line labeled 1. FIG. 9 is the cross section of the z-y plane at x=0 with the Cartesian Coordinates origin at the center cross. FIG. 9 shows a sensitivity region that is tilted towards the positive y-axis. For example, some tablets or notebook computing devices where the talker is positioned along the y-axis at the bottom of the computing device have a sensitivity region tilted towards the positive y-axis.

Figure 10:
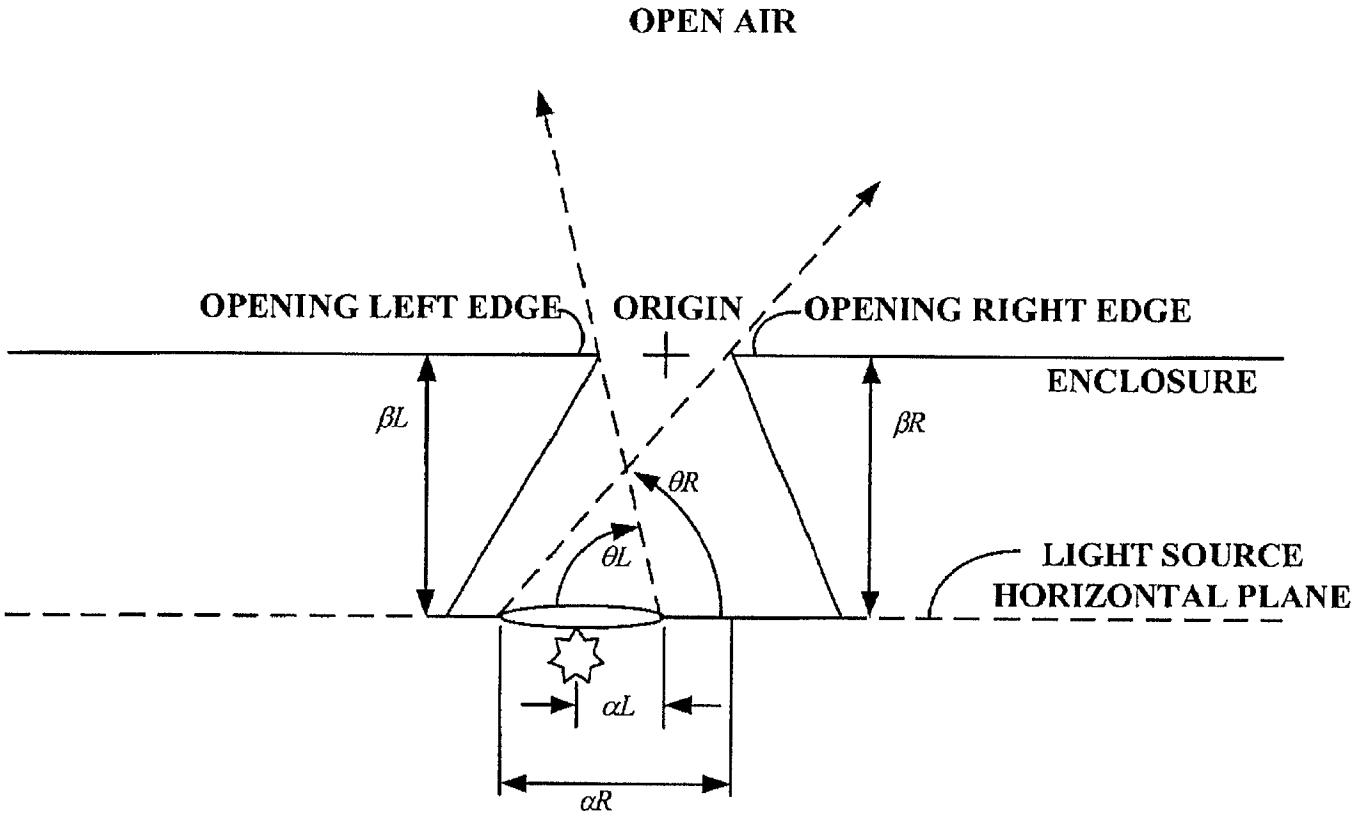
FIG. 10 is a detailed view of example geometry of the sectional view of FIG. 8.

FIG. 10 is a detailed view of example geometry of the sectional view of FIG. 8. In another embodiment, the depth (βL and βR) of the cavity 410 and the size and shape of the opening 404 are designed so that the light emitted from the opening 404 is only visible when the speaker's mouth is within the sensitivity region. The shape and depth of the cavity are designed to only allow light to be seen by a talker at a specific range of angles. Some example ranges are ±30 degrees azimuth, ±15 degrees azimuth, and ±7 degrees azimuth. The angles are chosen to coincide with the sensitivity region of the microphone and, therefore, it will be appreciated that other angles will be used for other microphones.

The diameter of the opening and depth of the cavity are chosen through geometry, given a distance of a talker from the microphone. For example, a typical distance is 18–24 inches or arms length. Theta ($\theta_L$) is determined from the equation $\theta_L$=arctan($\beta_L/\alpha_L$) for the left edge. Alpha ($\alpha_L$) is the shortest distance between the left edge of the cover and the orthogonal projection of the left enclosure edge onto the x-y plane at z=−depth. Depth is chosen to satisfy the angle greater than the cut-off angle of an array processing method. Beta ($\beta_L$) is the length of the orthogonal projection between the left edge of the enclosure and the x-y plane at z=−depth. FIG. 10 assumes the Cartesian Coordinates origin is at the center cross. The mirror calculation is done for the right edge equation $\theta_R$=arctan($\beta_R/\alpha_R$).

Figure 11:
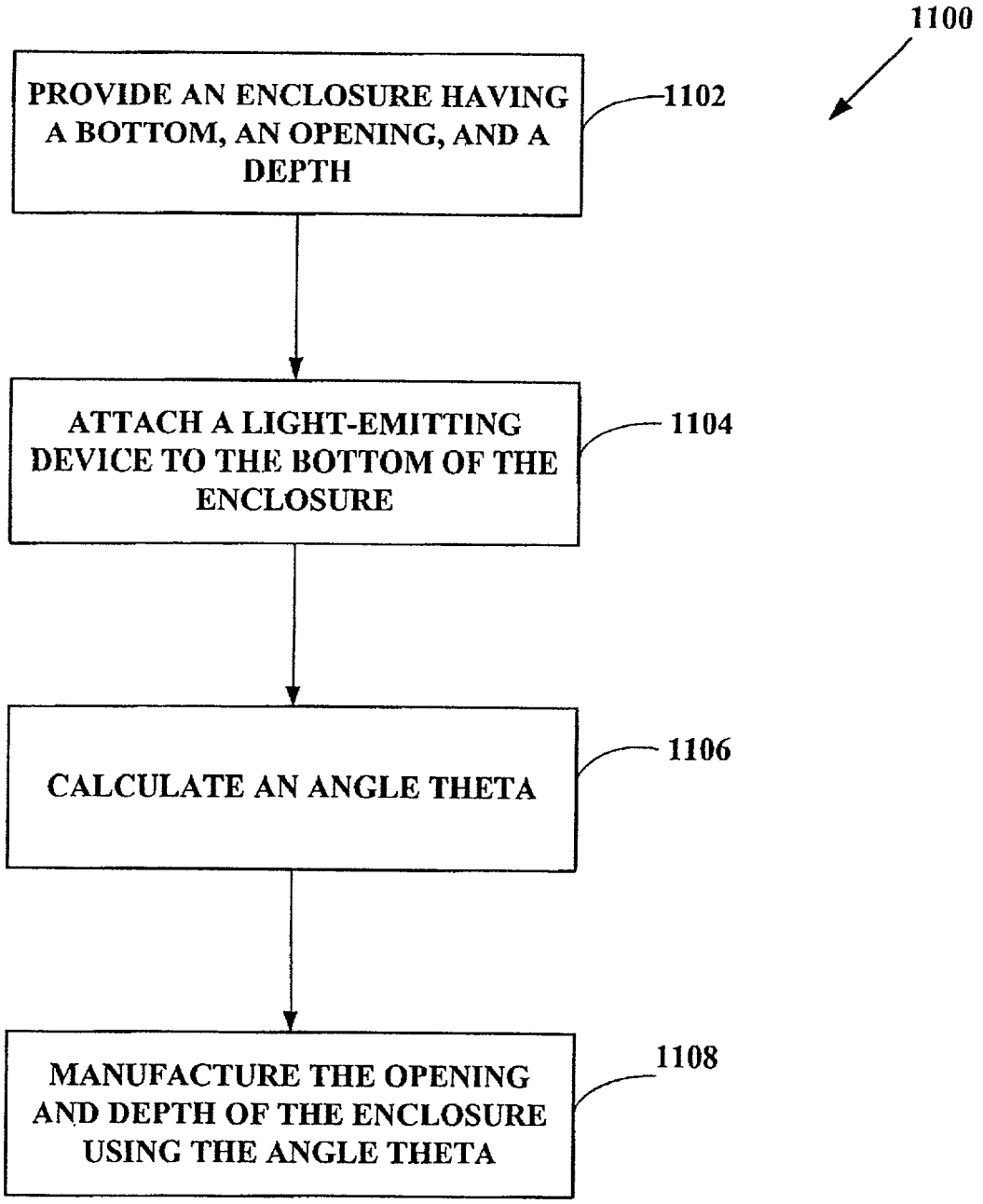
FIG. 11 is a flow chart of an embodiment of the present invention as a method of manufacturing a voice-bearing light.

FIG. 11 is a flow chart of an embodiment of the present invention as a method of manufacturing a voice-bearing light 1100, another aspect of the present invention. The manufacturer provides an enclosure having a bottom, an opening, and a depth 1102. A light-emitting device is attached to the bottom of the enclosure 1104. An angle theta (θ) is calculated so that the light-emitting device is only visible to a talker when the talker's mouth is within a sensitivity region of a microphone 1106. The opening and depth of the enclosure are manufactured 1108 so that the angle theta (θ) is an angle between a top surface of the light-emitting device and a projection line drawn from an edge of the opening to an opposite edge of the light-emitting device. In one embodiment, calculating the angle theta (θ) is performed by calculating θ=arctan (β/α), where beta (β) is a length of an orthogonal projection between an edge of the opening and the bottom of the enclosure and alpha (α) is a distance between the opposite edge of the light-emitting device and the orthogonal projection. In another embodiment, a cover is provided over the light-emitting device to diffuse the light and, then, theta (θ) is the angle between the top surface of the light-emitting device and the projection line drawn from the edge of the opening to the opposite edge of the cover over the light-emitting device.

Figure 12:
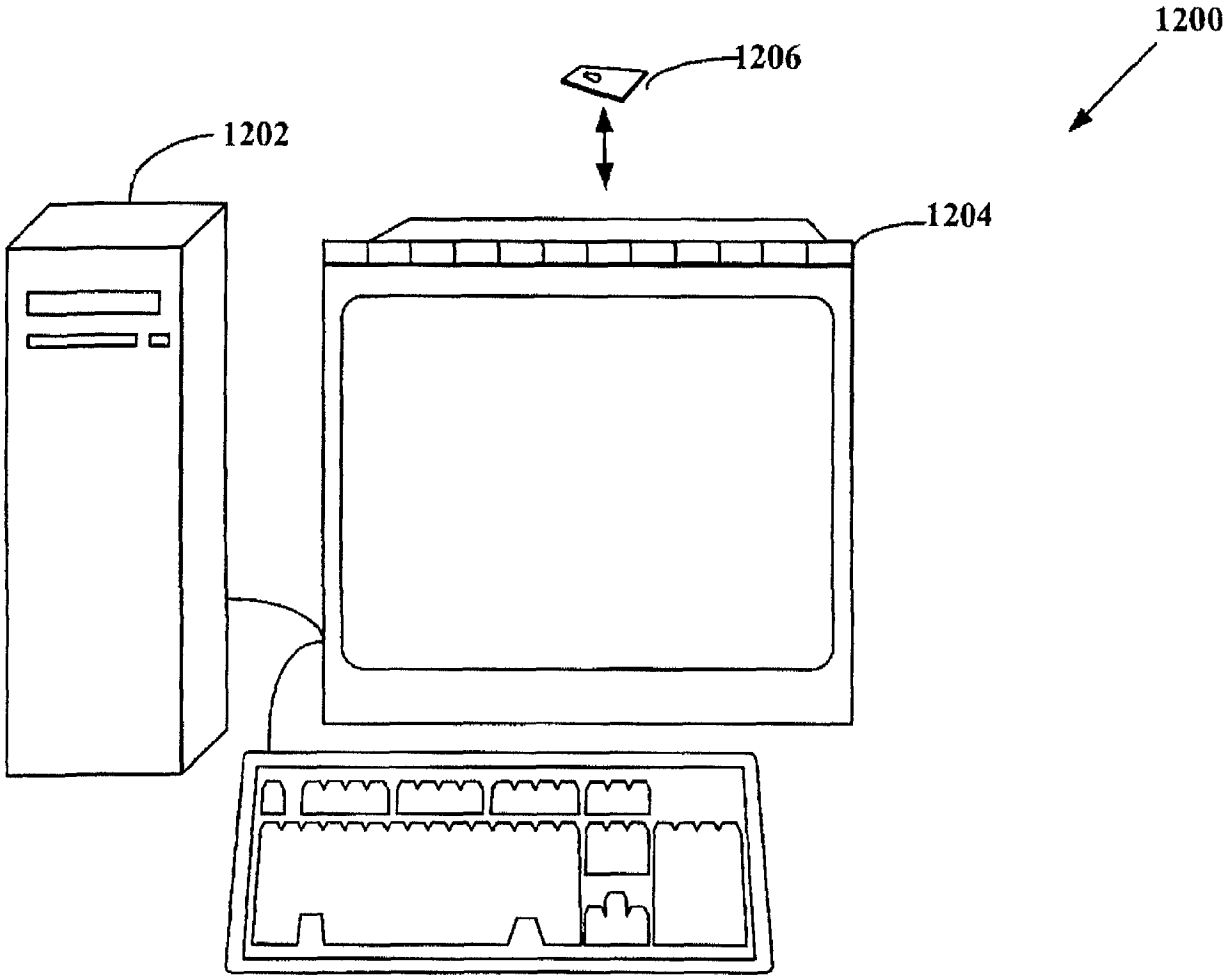
FIG. 12 is a block diagram of an example embodiment of the present invention as a speech-capturing system for a computer.

FIG. 12 is a block diagram of an example embodiment of the present invention as a speech-capturing system 1200 for a computer 1202. Another aspect of the present invention is a system, such as a speech-capturing system 1200. Such systems include speech recognition systems, speaker verification systems, conferencing systems, telephony, recording, kiosks, home appliances, and other systems. The system, such as a speech-capturing system 1200 comprises a microphone 1204 having a sensitivity region and a plug 1206 capable of coupling to the microphone 1204. The plug 1206 has an enclosure and a light-emitting device inside the enclosure to provide visual feedback to direct a speaker to stay within the sensitivity region. A plug may be made of any material, such as plastic and sold as a stand-alone component or in conjunction with a microphone. The plug has some means of attachment, such as a couple of wires at the back. The plug may be mechanically inserted, glued, or fused to a flush mount of the microphone. Some examples include a plug attached to a microphone in a visor of an automobile and a plug attached to a microphone on a swivel.

In one embodiment, the microphone 1204 is a microphone array. In another embodiment, the microphone array uses time delay estimation to establish the sensitivity region. In another embodiment, the system 1200 further comprises a speech recognition application using input from the microphone 1204. In another embodiment, the system 1200 further comprises a speaker verification application using input from the microphone 1204. In another embodiment, the system 1200 further comprises a conferencing application using input from the microphone 1204. In another embodiment, the system 1200 further comprises a telephony application using input from the microphone 1204. In another embodiment, the system 1200 further comprises a tablet coupled to the microphone 1204. In another embodiment, the system 1200 further comprises a computing device coupled to the microphone 1202. In another embodiment, the system 1200 further comprises an automobile application using input from the microphone 1204.

In another embodiment, the system 1200 further comprises an appliance coupled to the microphone 1204, the appliance receiving control input from the microphone 1204. One example is speech enabled kitchen appliances. A talker approaches a microwave until he sees the light and then says "3 ounces of popcorn," opens the door and puts the popcorn in, and closes the door. The microwave turns on automatically for the correct time and power. The talker then moves slightly to the right, looks for the light on the coffee machine and says, "start at 5 o'clock tomorrow morning." Without the present invention, speech enabled appliances close to one another might get confused, but with the visible light, the user is guided into the appropriate sensitivity region so that speech enabled appliances can live practically side by side.

It is to be understood that the above description it is intended to be illustrative, and not restrictive. Many other embodiments are possible and some will be apparent to those skilled in the art, upon reviewing the above description. For example any application or system using a microphone may benefit from a voice bearing light, many different types of microphones with various sensitivity regions may be used, various materials may be used for the components of the voice bearing light, many different kinds of light-emitting devices may be used, and more. Therefore, the spirit and scope of the appended claims should not be limited to the above description. The scope of the invention should be determined with reference to the appended claims, along with the full scope of equivalents to which such claims are entitled.

What is claimed is:

1. An apparatus, comprising:

an enclosure having an opening to a cavity;

a device to emit light at the bottom of the cavity; and a cover over the light-emitting device to diffuse the light;

wherein an angle theta between a top surface of the cover and a projection line drawn from an edge of the opening to an opposite edge of the light-emitting device enables light emitted through the opening to be visible to a speaker only when the speaker's mouth is within a sensitivity region of a microphone.

2. The apparatus recited in claim 1, wherein the depth of the cavity and the size and shape of the opening are designed so that the light emitted from the opening is only visible when the speaker's mouth is within the sensitivity region.

3. The apparatus recited in claim 1, wherein the enclosure is capable of attaching to the microphone.

4. The apparatus as recited in claim 1, wherein the microphone is a microphone array.

5. The apparatus as recited in claim 4, wherein the microphone array uses time delay estimation to establish the sensitivity region.

6. The apparatus as recited in claim 1, further comprising a speech recognition application using input from the microphone.

7. The apparatus as recited in claim 1, further comprising a speaker verification application using input from the microphone.

8. The apparatus as recited in claim 1, further comprising a conferencing application using input from the microphone.

9. The apparatus as recited in claim 1, further comprising a telephony application using input from the microphone.

10. The apparatus as recited in claim 1, further comprising a tablet coupled to the microphone.

11. The apparatus as recited in claim 1, further comprising a computing device coupled to the microphone.

12. The apparatus as recited in claim 1, further comprising an appliance coupled to the microphone, the appliance receiving control input from the microphone.

13. The apparatus as recited in claim 1, further comprising, an automobile application using input from the microphone.

14. The apparatus recited in claim 1, wherein the walls of the enclosure are coated to absorb light.

15. The apparatus recited in claim 1, wherein the sides of the cavity are sloped.

16. A method, comprising:

providing an enclosure having a bottom, an opening, and a depth;

attaching a light-emitting device to the bottom of the enclosure, wherein the light-emitting device has a top surface;

calculating an angle theta ($\theta$) so that the light-emitting device is only visible to a talker when the talker's mouth is within a sensitivity region of a microphone; and manufacturing the opening and depth of the enclosure so that the angle theta ($\theta$) is an angle between the top surface of the light-emitting device and a projection line drawn from an edge of the opening to an opposite edge of the light-emitting device.

17. The method as recited in claim 16, wherein calculating the angle theta ($\theta$) is performed by calculating $\theta$=arctan (beta ($\beta$)/alpha ($\alpha$));

wherein beta ($\beta$) is a length of an orthogonal projection between an edge of the opening and the bottom of the enclosure; and wherein alpha ($\alpha$) is a distance between the opposite edge of the light-emitting device and the orthogonal projection.

18. The method as recited in claim 16, further comprising:

providing a cover over the light-emitting device to diffuse the light;

wherein theta ($\theta$) is the angle between the top surface of the light-emitting device and the projection line drawn from the edge of the opening to the opposite edge of the cover over the light-emitting device.

* * * * *